US006631579B1

(12) United States Patent
Lauster et al.

(10) Patent No.: US 6,631,579 B1
(45) Date of Patent: Oct. 14, 2003

(54) DETENT FOR A HANDGUN

(76) Inventors: Peter Lauster, Liptingerstrasse 134, D-78532 Tuttlingen (DE); Harald Breinlinger, Stuttgarterstrasse 52, D-78532 Tuttlingen (DE)

( * ) Notice: Subject to any disclaimer, the term of this patent is extended or adjusted under 35 U.S.C. 154(b) by 0 days.

(21) Appl. No.: 09/623,886

(22) PCT Filed: Feb. 19, 1999

(86) PCT No.: PCT/EP99/01075

§ 371 (c)(1),
(2), (4) Date: Oct. 30, 2000

(87) PCT Pub. No.: WO99/46551

PCT Pub. Date: Sep. 16, 1999

(30) Foreign Application Priority Data

Mar. 12, 1998 (DE) ..... 298 04 386 U
Jul. 15, 1998 (DE) ..... 198 31 690

(51) Int. Cl.[7] ..... F41A 17/00

(52) U.S. Cl. ..... 42/70.11; 42/70.01; 42/70.08; 42/84

(58) Field of Search ..... 42/70.11, 70.01, 42/70.6, 70.7, 70.08, 84

(56) References Cited

U.S. PATENT DOCUMENTS 2,803,910 A * 8/1957 Lyle ..... 42/70.11
4,353,056 A * 10/1982 Tsikos
4,467,545 A * 8/1984 Shaw, Jr. ..... 42/70.11
4,488,370 A * 12/1984 Lemelson ..... 42/70.11
4,970,819 A * 11/1990 Mayhak ..... 42/70.11
5,325,442 A * 6/1994 Knapp
5,502,915 A * 4/1996 Mendelsohn et al. ..... 42/70.11
5,603,179 A * 2/1997 Adams ..... 42/70.11
5,937,557 A * 8/1999 Bowker et al. ..... 42/84
5,953,441 A * 9/1999 Setlak
6,253,480 B1 * 7/2001 Florez ..... 42/70.6
6,259,804 B1 * 7/2001 Setlak et al.
6,286,240 B1 * 9/2001 Collins ..... 42/70.08
6,286,242 B1 * 9/2001 Klebes ..... 42/84

* cited by examiner

*Primary Examiner*—Michael J. Carone
*Assistant Examiner*—L. Semunegus
(74) *Attorney, Agent, or Firm*—Bachman & LaPointe, P.C.

(57) ABSTRACT

The invention relates to a detent for a handgun, comprising at least one sensor for determining the identity of the user on the basis of at least one finger. According to the invention, a sensor determines the capacitance between a sensor surface and a section of the finger, an image of the finger section is generated from the voltage differences and said image is compared with memorized finger sections.

3 Claims, 2 Drawing Sheets

DETENT FOR A HANDGUN

The present invention relates to a safety device for a handheld firearm having at least one sensor for determining its user on the basis of at least one finger.

Previously known safety systems for handheld firearms, that is to say for handguns or long guns operate on the basis of mechanical principles of a conventional type. Functional elements of the weapon are inhibited by means of mechanical bolts.

In a weapon of a different type, the ammunition is fired electrically. A safety device for such electrical firing is provided by inhibiting or removing the electrical power source (Caliber/5.1991, page 14).

Other safety devices are described in Caliber/5.1991, page 65 and DWJ/1.1992, page 29.

A safety device of the above-mentioned type is disclosed in G 92 07 173 U1. This system takes fingerprints by means of scanner modules in order to then inhibit or enable the weapon. However, using conventional scanner modules to take fingerprints is highly complex and computer-intensive. The other systems are not suitable for protecting the weapon against unauthorized use.

U.S. Pat. No. 5,603,179 describes a safety device for identifying handprints or fingerprints of various persons, for handheld firearms. In this case, a scanner sensor using infra-red light is used in each case, which scans individual skin structures of a fingerprint step-by-step, and supplies the individual points of the fingerprint as a reference value in a poor, coarsely resolved form for checking that this is a permissible user. A disadvantage of this is that such scanning is inaccurate and takes an extremely large amount of time. In this case, a plurality of sensors are assigned directly to the trigger, in order to scan a skin structure. Rapid gripping does not position the finger exactly and precisely on the sensor, so that a stored skin structure may not be identified exactly, due to movement.

The present invention is based on the object of ensuring reliable protection of a weapon against unauthorized use, with the aim being for this to be done quickly and cost-effectively.

In order to achieve this object, the capacitance between a sensor surface and a finger section is determined by means of a sensor, an image of the finger detail is produced from the voltage differences, and this image is compared with stored finger details.

Such sensors are known and are used, for example, to cancel an access inhibit to a network, or to identify people. For the present situation, they are particularly suitable for canceling the inhibit of a handheld firearm.

In a further exemplary embodiment, the sensor is intended to be a scanner camera which makes an optodigital or electronic record of the fingerprint and/or of the finger contour (fingerprinting).

In comparison with a scanner module, a scanner camera has the advantage that, within fractions of seconds, it can detect a fingerprint and supply it to a computer unit which then compares the fingerprint with stored fingerprints. The scanner camera operates considerably more quickly and reliably than a scanner module. The image detected by the scanner camera can be digitized immediately.

Misuse is prevented since the weapon can be made operational only by the authorized user. Even if force is used and the authorized user is, for example, forced to grip the weapon, the weapon is blocked again once the user has released the grip, so that the criminal cannot do anything with the weapon.

A similar solution to the said object is also achieved by the sensor being an electrochemical sensor which carries out DNA fingerprinting. The sensor may also be an ultrasound scanning sensor which takes the fingerprints of the user by means of acoustic signal measurement. Furthermore, the determination of the user can be carried out by means of a comparison measurement of the heart rate frequency, by means of heart rate frequency sensors. Such sensors are commercially available, so that there is no need to describe them in any more detail.

To record the fingerprint, the at least one scanner camera is preferably fitted in a grip of the handheld firearm. However, it is also feasible to arrange it at some other point, but the arrangement in the grip is preferred since, as a rule, the grip must be held by the user in order to use the weapon correctly.

The scanner camera has an associated computer unit which is in turn supplied from an electrical power source. Both elements are likewise preferably located in the grip of the weapon.

Furthermore, the computer unit preferably has an associated memory unit in which the fingerprints of the authorized user or users are stored. This memory unit should be designed so that it cannot be cracked by any third parties.

Electromechanical inhibits are of primary interest as inhibits and, for example, act on a trigger, a safety lever, a hammer or the like. That is to say they block one or more of these functional elements, but can be unlocked by application of electrical power.

A further option is to block a magazine holder. It is thus impossible for an unauthorized user to remove the magazine from the grip.

In one particularly preferred exemplary embodiment of the invention, for which separate patent protection is also desired, the handheld firearm has an associated radio signal transmitter which can be connected to a satellite navigation system. In order that this does not take place all the time, although it is possible, the radio signal transmitter is not intended to be activated until after a specific time, provided an authorized user does not communicate to the computer unit, by holding the grip, that the weapon is still being controlled by an authorized user. For example, this time may be about 12 hours since, for example within this time it is necessary for the grip to be held in the hand, for insertion of the weapon into a holster, for removal of the weapon from the holster after the end of a period on duty, for example of a policeman.

Further advantages, features and details of the invention result from the following description of preferred exemplary embodiments and with reference to the drawing, in which.

Figure 1:
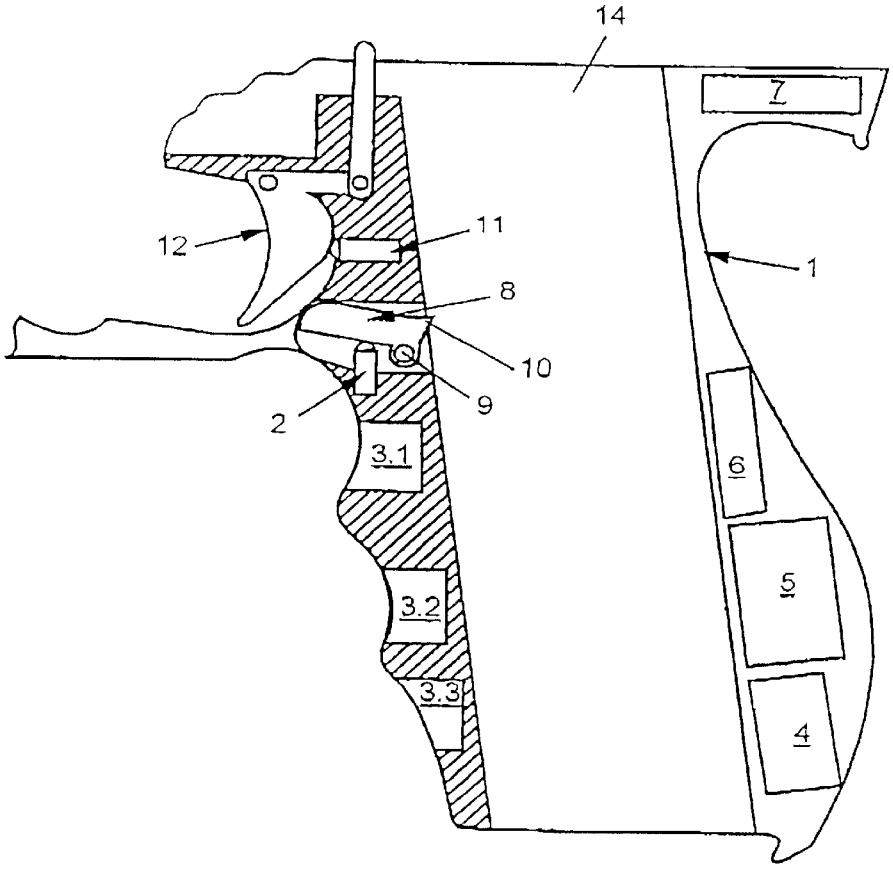
FIG. 1 shows a partially schematically illustrated cross section through a part of a handheld firearm.

FIG. 1 essentially shows a grip 1 of a handheld firearm, in which grip 1 there is a space 14 for a magazine which is not shown in any more detail. This magazine is held in the space 14 by a magazine holder 8, with this magazine holder 8 rotating about a shaft 9 and having a latching catch 10 which can latch into a corresponding recess in the magazine.

In the latched position, the magazine holder 8 is held by means of an electromechanical inhibit 2 which, in the present exemplary embodiment, is in the form of a bolt which, for example, may be surrounded by a coil body which results in the bolt moving in or out when electricity is applied to the coil body.

Furthermore, a trigger 12 for operating a firing member is indicated, which firing member is not shown in any more detail, but can likewise be inhibited by means of an electromechanical inhibit 11.

Three optodigital sensors 3.1 to 3.3, which are in the form of scanner cameras, are indicated schematically underneath the magazine holder 8. These sensors 3.1 to 3.3 are used to take fingerprints from a human hand, to be precise of the middle finger, ring finger and little finger.

Figure 2:
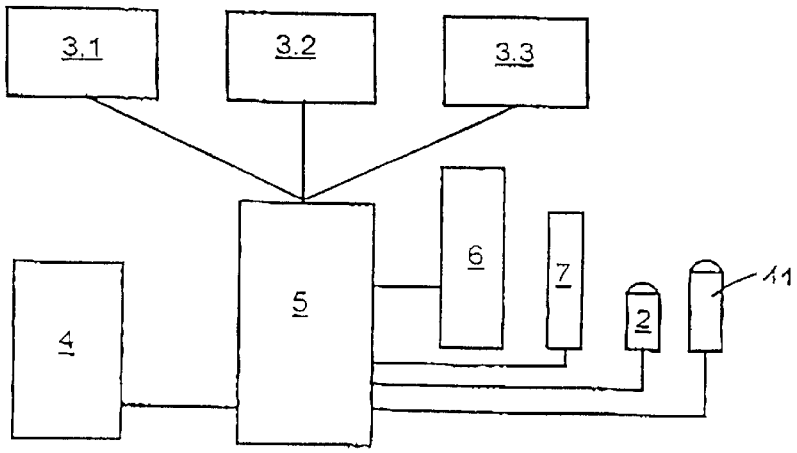
FIG. 2 shows a block diagram illustration of an optodigital or electronic grip safety device according to the invention.

As indicated in FIG. 2, the sensors 3.1 to 3.3 are connected to a computer unit 5, which is likewise located in the grip 1. The computer unit 5 is fed from an electrical power source 4 which may be, for example, in the form of a button battery cell. A memory unit for the computer is also indicated separately, at 6.

A radio signal transmitter 7 is also integrated in the grip 1 and can be connected to a satellite monitoring system. This radio signal transmitter 7 is also coupled to the computer unit 5.

The method of operation of the present invention is as follows:

When not in the in-use position, the electromechanical inhibit 11 and the electromechanical inhibit 2 for the magazine holder are in the inhibited position. This means that the weapon cannot be operated.

If an authorized user wishes to use the weapon, his firing hand holds the grip 1 such that the middle finger, ring finger and little finger are in contact with the sensors 3.1 to 3.3. The scanner cameras take the fingerprints of these fingers, and pass them to the computer unit 5. In the computer unit 5, the fingerprints are compared with stored fingerprints from the memory unit 6. If the fingerprints are found to match, then the electromechanical inhibits 2 and 11 are released, so that the trigger and magazine are enabled. The weapon can now be used directly.

If, on the other hand, the weapon is held by an unauthorized user, then the computer unit 5 does not find his fingerprints in the memory unit 6, so that the electromechanical inhibits 2 and 11 are not released either. The weapon is unusable.

If the weapon is not used by the authorized user within a predetermined time period, then the computer unit tells the radio signal transmitter 7 that it should transmit appropriate radio signals. These radio signals are received by a known satellite navigation system which in turn determines where the weapon is located at that time. A weapon which has been lost or stolen can thus be found again at any time.

Figure 3:
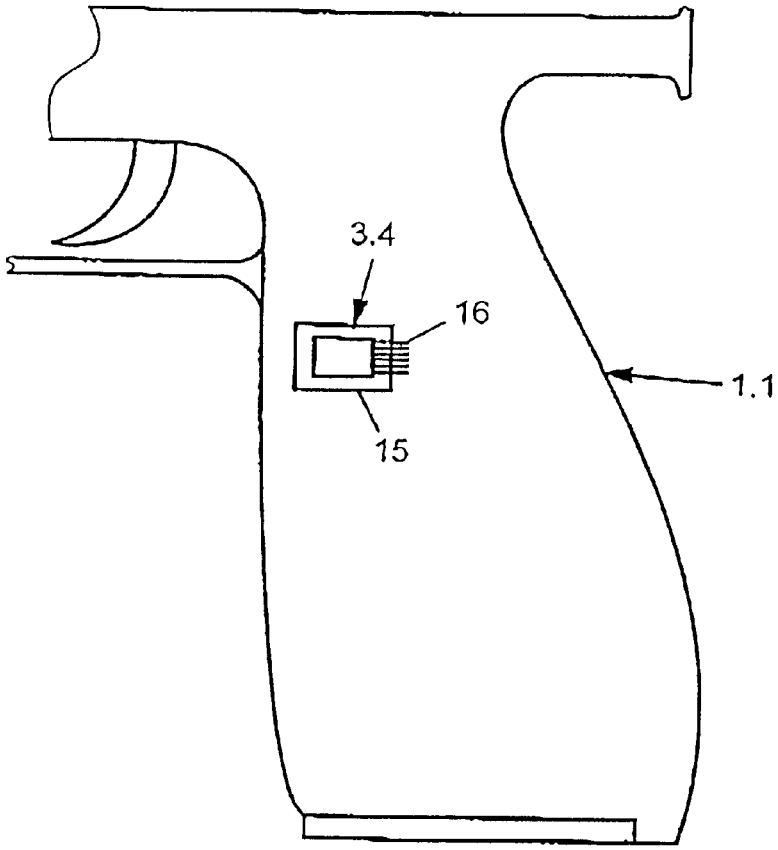
FIG. 3 shows a partially illustrated plan view of a further exemplary embodiment of a handheld firearm according to the invention.
Figure 4:
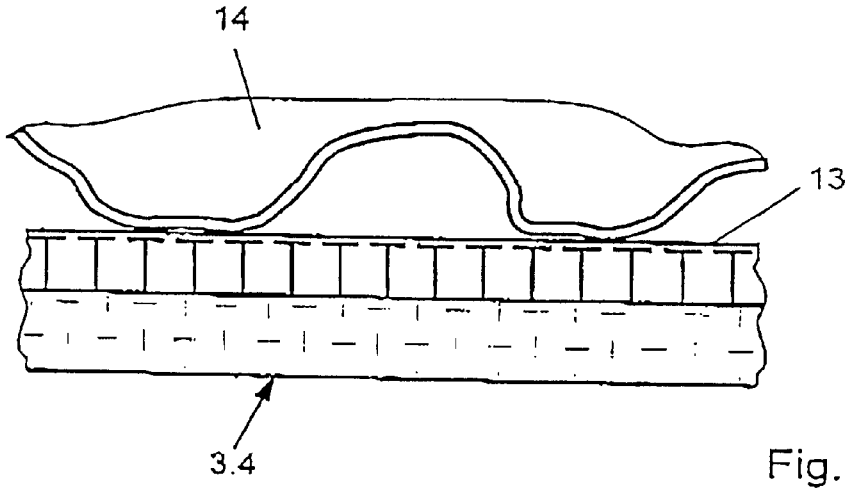
FIG. 4 shows a part of a cross section, shown enlarged, through a sensor according to the invention.

FIGS. 3 and 4 show a further exemplary embodiment of a sensor 3.4 according to the invention. In this case, this is a capacitive sensor, which measures the capacitance between a sensor surface 13 and a finger section 14. Different voltage values are produced in this case, and an image of the finger section 14 can be produced from the voltage differences. This is done, for example, digitally.

The sensor 3.4 has a frame 15 which is preferably grounded to the housing. This means that the frame 15 discharges to the housing any higher voltage which may be present on the finger surface.

Furthermore, a large number of connections 16 are indicated, by means of which the sensor 3.4 is connected to a computer in which the image of the finger section 14 is produced. Furthermore, a number of details of the finger are stored in the computer, with the computer carrying out an association process between the determined image of the finger section and the stored images. Generally, such a sensor 3.4 should also be provided on the opposite side of the grip 1.1, so that the handheld firearm can also be operated by someone who is left-handed. For example, a circuit is also possible which maintains the usability of the weapon if it is firstly gripped with the right hand, and then changed to the left hand. If no signal is produced by the second sensor within a certain, short time, the weapon is once again inhibited.

What is claimed is:

1. A safety for a handheld firearm for determining a user on the basis of at least one finger detail comprises at least one sensor means which measures a capacitance between a surface on the at least one sensor means and the at least one finger detail of the user for producing an image of the at least one finger detail which is compared to stored finger details wherein the at least one sensor means has an associated computer unit and electrical power source in the firearm, and wherein the computer unit is connected to a control means for blocking a magazine holder which inhibits operation the weapon.

2. A safety for a handheld firearm for determining a user on the basis of at least one finger detail comprises at least one sensor means which measures a capacitance between a surface on the at least one sensor means and the at least one finger detail of the user for producing an image of the at least one finger detail which is compared to stored finger details wherein the at least one sensor means has an associated computer unit and electrical power source in the firearm, and wherein the control means is an electromechanical means which inhibits one of a trigger, a safety lever, and a hammer.

3. A safety device according to claim 1 or 2 wherein the at least one sensor means is fitted in a grip of the handheld firearm.

* * * * *